United States Patent [19]

Merl et al.

[11] Patent Number: 4,540,093

[45] Date of Patent: Sep. 10, 1985

[54] DISPLAY HOOK APPARATUS

[76] Inventors: Milton J. Merl, 151 S. Mountain Rd., New City, N.Y. 10956; Silvio J. Di Marchi, 9 Ward Ave., Wyckoff, N.J. 07481

[21] Appl. No.: 507,245

[22] Filed: Jun. 23, 1983

[51] Int. Cl.[3] ..... A47F 5/00

[52] U.S. Cl. ..... 211/59.1; 40/16.4; 248/220.3; 248/220.4

[58] Field of Search ..... 211/57.1, 59.1, 106; 248/220.3, 220.4, 221.1, 221.2; 40/19.5, 16.4

[56] References Cited

U.S. PATENT DOCUMENTS

| | | | |
|---|---|---|---|
| 1,033,915 | 7/1912 | McDonald . | |
| 1,951,611 | 3/1934 | Hooge | 40/19.5 |
| 3,141,253 | 7/1964 | Bartram | 40/129 |
| 3,469,813 | 9/1969 | Rizzi | 248/475 |
| 3,610,425 | 10/1971 | Madey | 248/220.3 |
| 3,645,485 | 2/1972 | Gold | 248/223 |
| 3,877,163 | 4/1975 | Bissonet | 40/16.4 |
| 4,246,710 | 1/1981 | Mixer | 40/16.4 |
| 4,319,731 | 3/1982 | Pfeifer | 248/223.4 |
| 4,351,440 | 9/1982 | Thalenfeld | 211/57.1 |
| 4,394,909 | 7/1983 | Valiulis et al. | 248/220.4 X |

FOREIGN PATENT DOCUMENTS

| | | | |
|---|---|---|---|
| 714703 | 9/1954 | United Kingdom | 248/220.3 |

OTHER PUBLICATIONS

"Fish ® Hook Front Information Safety Hooks", data sheet, date and author unknown.

*Primary Examiner*—Robert W. Gibson, Jr.
*Attorney, Agent, or Firm*—Wolder, Gross & Yavner

[57] ABSTRACT

A display hook for the presentation of items upon a vertical supporting surface consists of a product support member and an overlying front channel support arm. The front channel member is adapted to receive consumer-oriented information upon its front face and store personnel-related information upon its rear face. The front channel member is pivoted upon the support arm such that the normal position of the channel allows viewing.

7 Claims, 5 Drawing Figures

DISPLAY HOOK APPARATUS

The present invention relates to a new and improved apparatus for the presentation of items in a store environment. In particular, it relates to a device which allows items to be racked upon a hook mechanism for display while providing both consumer and store reorder information.

Within the retailing industry, product peg hooks are utilized to display and present items which have packaging which allows the product to be hung or suspended from a projecting rod. Normally the individual peg hooks comprise a part of large scale display in which numerous products, each one being located on an individual hook, are displayed. When utilized as a part of such a large-scale display, provision must be made for the display of consumer information at a location easily seen by the consumer. Placing such information at the rear of the hook, for example, is impractical and is a waste of valuable space. In addition, as product is depleted store personnel must be provided with appropriate information to permit the product to be restocked. With the introduction of UPC and other inventory codes, provision must be made for such information, in addition to the consumer information, and such information must be placed above or below the product.

The front rails of shelves are most often used to display UPC and other inventory code information. With the use of peg hooks, however, such shelf front rails are not there, and it has therefore become a standard practice to affix, attach or otherwise mount a plate to the top front of the peg hook configuration for affixation of the UPC data. This, however, precludes the display of consumer information. This causes severe retail problems in that, without appropriate consumer information, the consumer is confronted by reorder codes only.

It is therefore the purpose of the present invention to provide a new and improved display hook apparatus which allows both consumer and store reorder information to be available at the front of the apparatus, so that it is available as required.

A further purpose of the present invention is to provide a new and improved hook which permits instant interchange of the product information carrier.

A further purpose of the present invention is to save valuable space. Through the "flipping" action of a front information-carrying channel member which permits information to be placed on front and back surfaces of the channel member.

A still further purpose of the present invention is to provide a new and improved display hook apparatus which, while displaying both consumer and restocking information, insures that the consumer information is automatically presented for viewing by the consumer.

In accordance with the above and other objects, the hook of the present invention includes a mount of conventional configuration designed and adapted to be mountable upon a vertical surface, such as a section of perforated board. Projecting outwardly from the mount is a product support arm. Overlying the product support arm is a second arm which extends beyond the product arm, bearing at its outboard end a hanging, pivotable front channel member. The channel member is two sided and permits the insertion of consumer information on the front side and reorder code information on the reverse side. The channel member is pivotable from a first position, in which its front face bearing the consumer information is visible, to a second position in which the reverse face, bearing the reorder information, is visible. The channel member is removable from the overlying arm to allow interchange of the channels to accommodate different messages.

A greater understanding of the present invention will be afforded upon consideration of the following, detailed description of a preferred, but nonetheless illustrative embodiment of the present invention when taken in conjunction with the annexed drawings, wherein.

Figure 1:
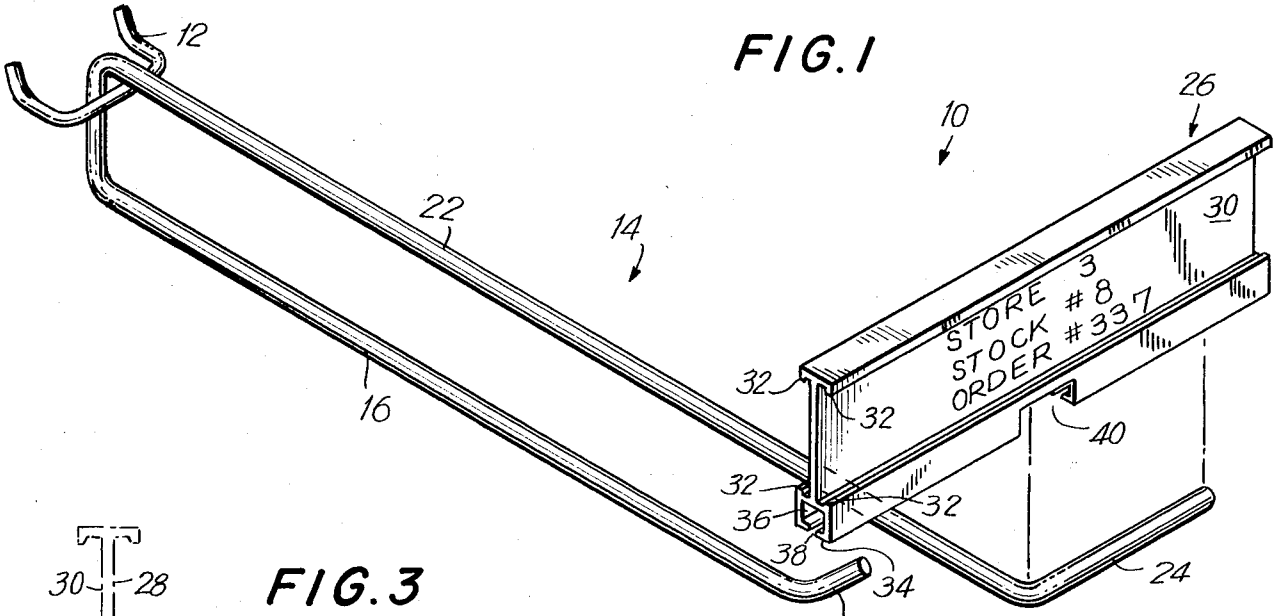
FIG. 1 is a perspective view of the present invention illustrating the insertion of the front channel onto the product support.
Figure 3:
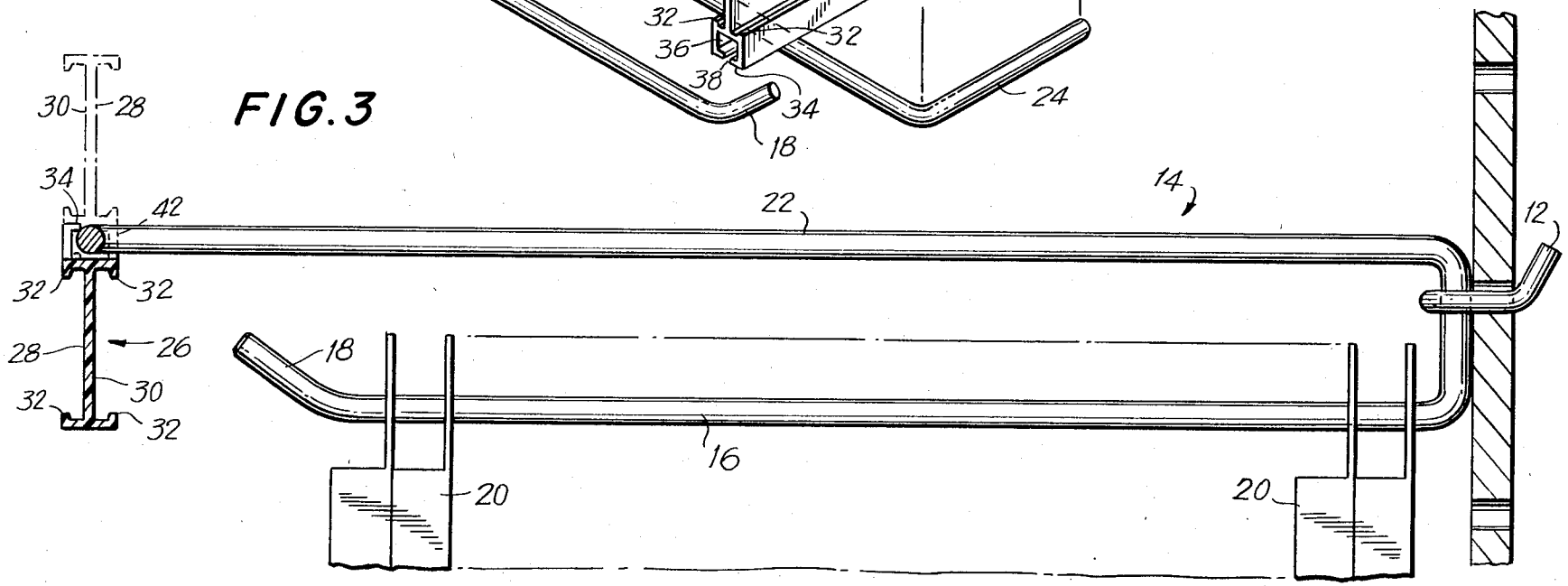
FIG. 3 is a sectional elevation view of the invention taken along line 3–3 of FIG. 2.
Figure 2:
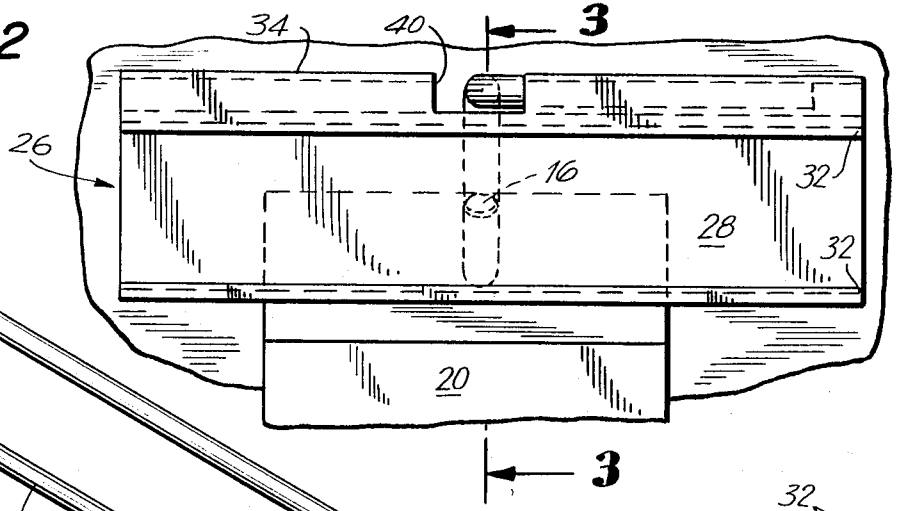
FIG. 2 is an elevation view of the invention.

Referring to the figures, display apparatus 10 includes upwardly directed and rear facing dual hook mounting member 12, adapted to support the apparatus on a conventional vertically oriented perforated wall, such as that generally known as "pegboard". Alternatively, any other fastener may be used to affix the device to the mounting surface. Projecting outwardly from the hooks 12 and affixed thereto by welding or similar process is dual product support and front channel support arm 14. Product support portion 16 is provided with an upturned end 18 to allow the product, designated 20 in the drawings, to remain on the arm without risk of dropping. Front channel support arm section 22 extends outwardly beyond upturned end 18 of the product support arm portion, and is provided with a horizontal, right angle section 24, upon which front channel member 26 is snap-mounted.

Front channel member 26 includes front face 28 and rear face 30, upon which consumer information and reorder information may be placed, respectively. The front channel member may be of extruded plastic and includes a pair of inwardly directed, channel forming members 32 on both front and rear faces to provide a means by which the appropriate information labels may be supported upon the channel member.

Figure 5:
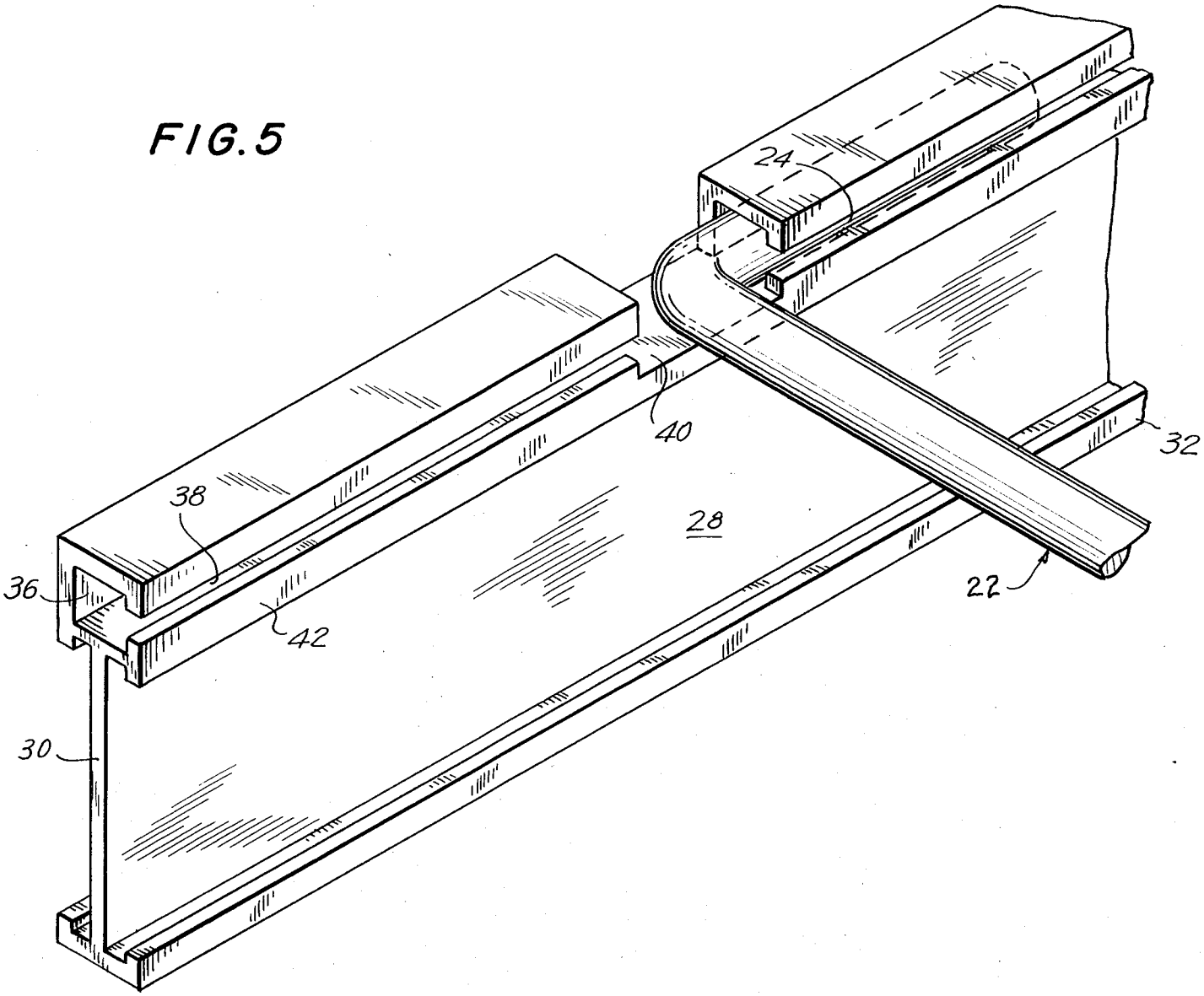
FIG. 5 is a partial perspective view illustrating an alternative method of fixation of the front channel member to the channel support arm.

The top edge 34 of the channel member is further provided with necked aperture 36 extending along its length, the neck 38 of the aperture projecting through the top edge 34 of the channel member. Necked aperture 36 is so dimensioned such that right angle portion 24 of support arm 22 may be supported therein, to allow the channel member to pivot. Cutout section 40 is provided to allow complete rotation of the channel member 26 from the lower, depending position in which its front face bearing customer information is visible to the upper position in which its-rear face, bearing reorder information, can be seen. Instead of projecting through top edge 34 of channel member 26, necked aperture 36 may also be located for entry of the right angle portion 24 of support arm 22 through the upper portion 42 of rear face 30 FIG. 5.

Slot or cutout section 40 also provides the means by which the channel member is supported on the apparatus while preventing the member from sliding off the support arm. As the front channel is of an appropriate material which has resiliency, cutaway section 40 and neck aperture 36 also allow the front channel members to be interchanged by a simple snap fit process, thus allowing the apparatus to be customized as the product displayed on the hook changes.

The pivoting action of front channel member 26 permits both customer and reorder information to be placed in front of the product and in alignment therewith. This allows a more compact arrangement of products, since additional support panel area is not needed to display information. Further, while both consumer and reorder information are readily available, channel member 26 normally assumes the dropped or depending position in which consumer information faces outward. After pivoting the channel member upward for access to reorder information the channel member automatically returns to the depending position, thus insuring that consumer information, rather than store personnel oriented reorder information, remains in view of the consumer.

Figure 4:
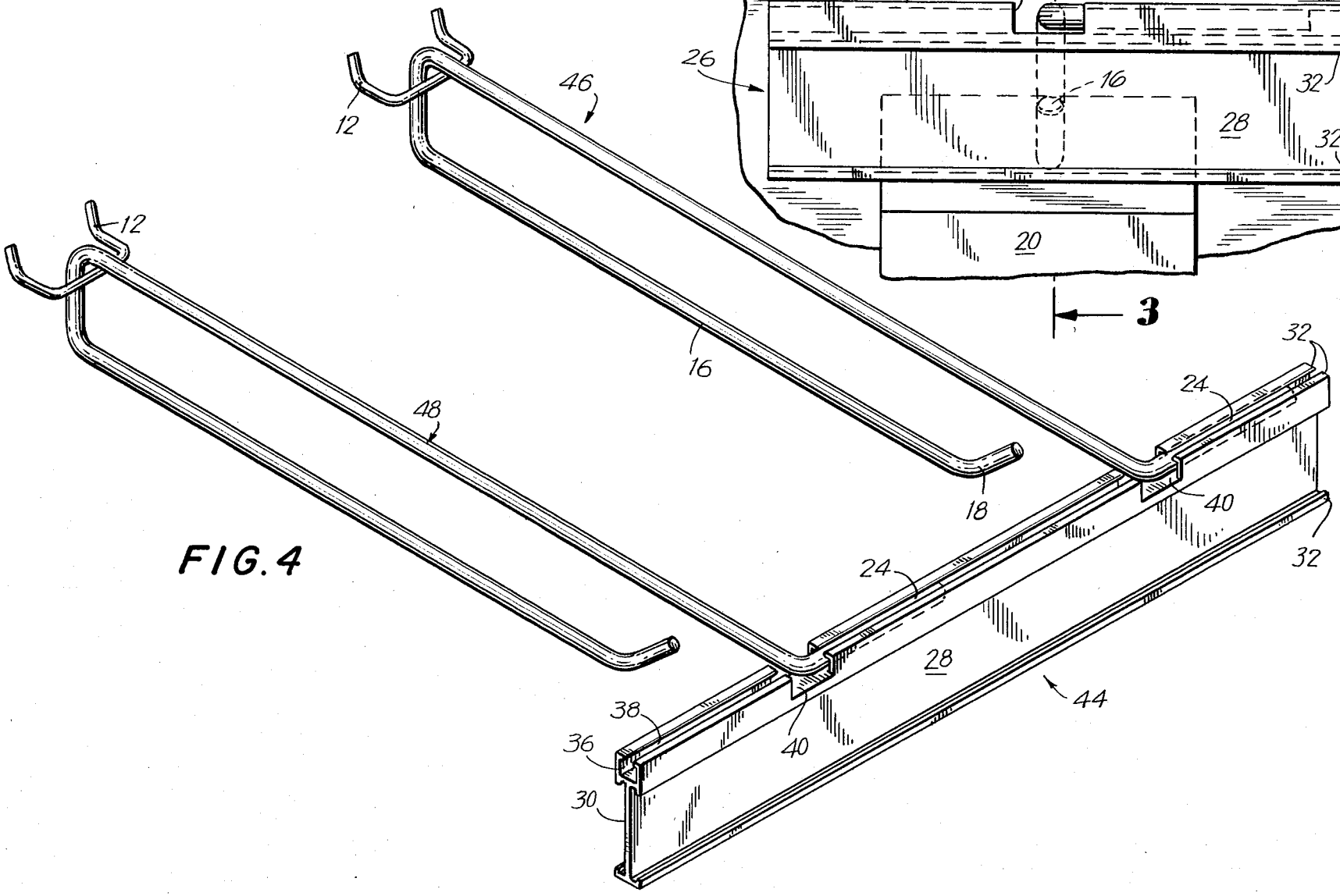
FIG. 4 is a perspective view of a multiple arm version of the invention.

The present invention can be easily adapted to display a plurality of products. As illustrated in FIG. 4, front channel member 44 spans the distance between support members 46 and 48. Additional product support hooks (not shown) may be mounted between the outboard support members 44 and 46. Appropriate customer and reorder information for the products carried on each of the hooks of the resulting assembly may be displayed on the front channel member 42, thus providing a fully integrated display for a related group of products.

It is to be recognized that numerous modifications, changes and adaptations to the present invention are possible, therefore the true scope of the invention is to be measured by the annexed claims.

What is claimed is:

1. An apparatus for the support and display of a group of related products from a vertical surface along a horizontal row, comprising first and second front channel membr support means mountable upon the vertical surface in a horizontaly spaced-apart relationship, each of said support means comprising mounting means adapted for mounting upon the vertical surface and an arm having a first end extending outwardly from said mounting means; a front channel member having front and rear surfaces pivotably mounted upon said first ends of said first and second support means such that said channel member normally depends therefrom, exposing said front surface and may be pivoted upwardly to expose said rear surface, whereby display information relating to the products may be located on said first surface and secondary information may be available for viewing when said channel member is pivoted upward; and product bracket means mounted to and extending outwardly from said mounting means below said support means such that products may be displayed therefrom behind said front channel member.

2. The apparatus of claim 1 wherein said product bracket means and said front channel support means are formed from a continuous length of rod stock.

3. The apparatus of claim 1 further comprising one or more additional product bracket means mountable to said vertical surface located along the horizontal line defined by said product bracket means such that they project outwardly from said vertical surface such that additional products may be displayed thereon behind said channel member.

4. An apparatus for the support and display of items, comprising mounting means adapted for mounting upon a vertical surface; bracket means extending outwardly from said mounting means for supporting a series of items; an arm having a right angle first end, said arm extending outwardly from said mounting means above said bracket means and extending beyond the end of said bracket means, said arm and bracket means being formed of a continuous length of rod stock; and a free-swinging, removable front channel member having front and rear surfaces and a necked aperture engageable with said arm first end, said front channel member being pivotely mounted to said first end of said arm within a notch formed in said necked aperture such that the sides of said notch limit the sideways motion of said arm in said aperture, such that said channel member normally depends from said arm, exposing said front surface and may be pivoted upwardly to expose said rear surface, whereby display information may be located on said front surface and secondary information may be available for viewing when said channel member is pivoted upward.

5. The apparatus of claim 4 wherein said necked aperture is proximate the upper edge of said front channel member.

6. The apparatus of claim 5 wherein said necked aperture extends through said upper edge of said front channel member.

7. The apparatus of claim 5 wherein said necked aperature extends through the rear surface of said front channel member.

* * * * *